US010495092B2

(12) United States Patent
Haddad et al.

(10) Patent No.: US 10,495,092 B2
(45) Date of Patent: Dec. 3, 2019

(54) PUMP FOR CONVEYING WASTE WATER AS WELL AS IMPELLER AND BASE PLATE FOR SUCH A PUMP

(71) Applicant: Sulzer Pumpen AG, Winterthur (CH)

(72) Inventors: Kais Haddad, Erlangen (DE); Horst-Paul Klein, Lohmar (DE)

(73) Assignee: Sulzer Management AG, Winterthur (CH)

( * ) Notice: Subject to any disclaimer, the term of this patent is extended or adjusted under 35 U.S.C. 154(b) by 545 days.

(21) Appl. No.: 14/408,558

(22) PCT Filed: Aug. 21, 2013

(86) PCT No.: PCT/EP2013/067350
§ 371 (c)(1),
(2) Date: Dec. 16, 2014

(87) PCT Pub. No.: WO2014/029790
PCT Pub. Date: Feb. 27, 2014

(65) Prior Publication Data

US 2015/0240818 A1 Aug. 27, 2015

(30) Foreign Application Priority Data

Aug. 23, 2012 (EP) ..... 12181520

(51) Int. Cl.
*F04D 7/04* (2006.01)
*F04D 29/42* (2006.01)
*F04D 29/22* (2006.01)

(52) U.S. Cl.
CPC ..... *F04D 7/04* (2013.01); *F04D 29/2294* (2013.01); *F04D 29/4293* (2013.01)

(58) Field of Classification Search
CPC ..... F04D 7/04; F04D 7/045; F04D 29/2288; F04D 29/2294; F04D 29/242;
(Continued)

(56) References Cited

U.S. PATENT DOCUMENTS 1,754,992 A 4/1930 Fabrin
2,272,469 A * 2/1942 Lannert ..... F04D 29/225 415/204
(Continued)

FOREIGN PATENT DOCUMENTS

CN 20180561 U 4/2011
DE 3015755 A1 11/1981
(Continued)

OTHER PUBLICATIONS

International Search Report and Written Opinion dated Oct. 1, 2013, from PCT Application No. PCT/EP2013/067350 (11 pages).

*Primary Examiner* — Carlos A Rivera
*Assistant Examiner* — Alexander A White
(74) *Attorney, Agent, or Firm* — Kilpatrick Townsend & Stockton, LLP

(57) ABSTRACT

Disclosed is an impeller for a pump for conveying waste water having a support body which can be rotated about an axis of rotation (A) and on which two blades for conveying are provided, wherein the blades each have an inlet region which extends from an inlet edge up to an apex, wherein the wall thickness increases at its end side remote from the support body in the inlet region from the inlet edge and reaches its maximum value at the apex, wherein the blade converges in the inlet region in an axial direction from the support body to the end side with respect to the wall thickness. A base plate is furthermore proposed for interaction with such an impeller as well as a pump for conveying waste water.

15 Claims, 4 Drawing Sheets

Figure 1:
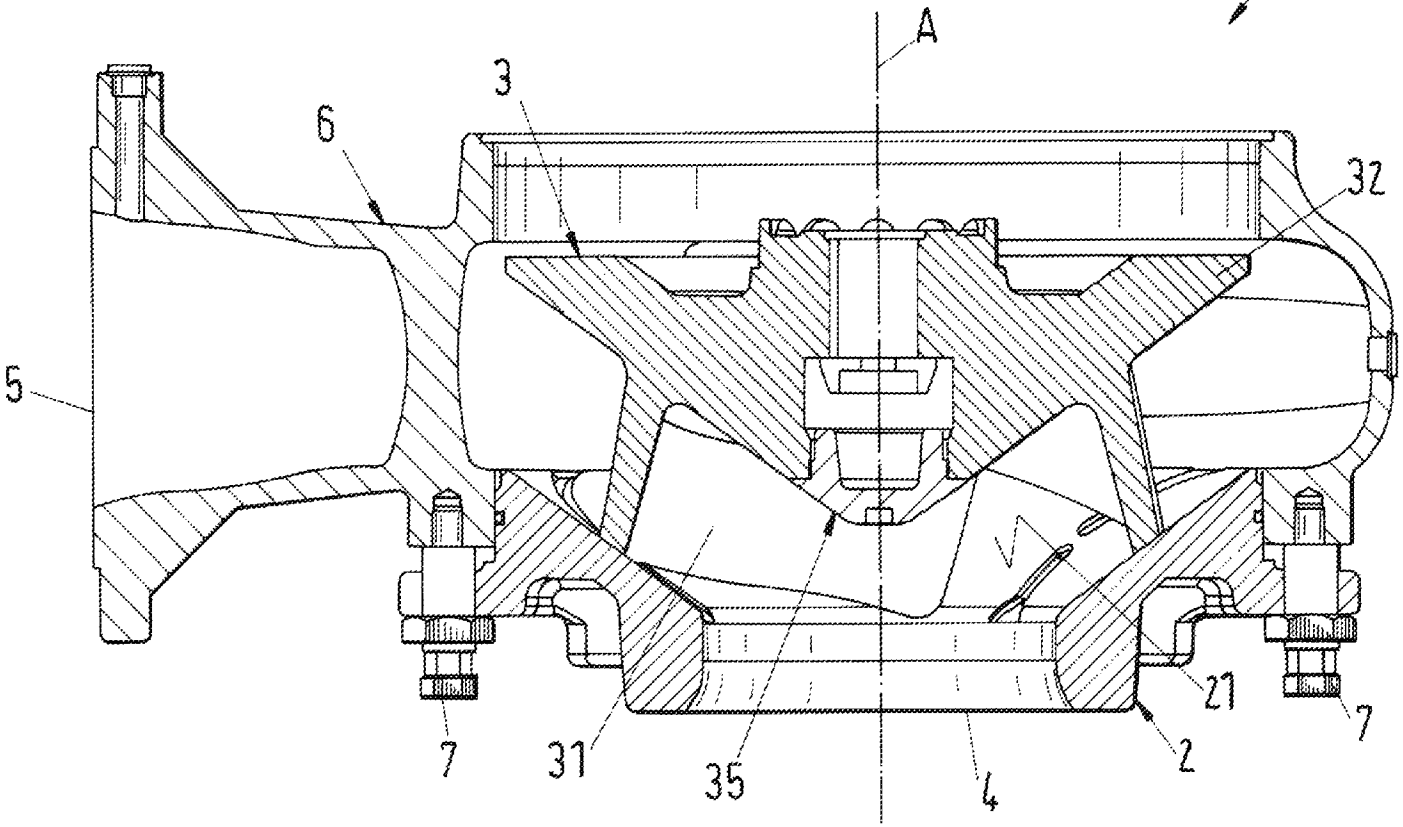

(58) Field of Classification Search
CPC ..... F04D 29/4273; F04D 29/4293; B02C 18/0084; B02C 18/0092
See application file for complete search history.

(56) References Cited

U.S. PATENT DOCUMENTS

| | | | | |
|---|---|---|---|---|
| 3,447,475 | A * | 6/1969 | Blum | F04D 7/045 415/121.1 |
| 8,025,479 | B2 * | 9/2011 | Scott | F04D 7/04 415/206 |
| 8,109,730 | B2 * | 2/2012 | Andersson | F04D 7/045 415/121.1 |

FOREIGN PATENT DOCUMENTS

| | | | |
|---|---|---|---|
| DE | 102011007907 | B3 | 6/2012 |
| EP | 0750119 | A1 | 12/1996 |
| FR | 980672 | A | 5/1951 |
| GB | 280120 | A | 11/1927 |
| WO | 2007/126981 | A2 | 11/2007 |

* cited by examiner

PUMP FOR CONVEYING WASTE WATER AS WELL AS IMPELLER AND BASE PLATE FOR SUCH A PUMP

This application is a U.S. National Phase of International Application No. PCT/EP2013/067350, filed Aug. 21, 2013, which claims priority to European Patent Application No. 12181520.3, filed Aug. 23, 2012, the disclosures of which are incorporated by reference herein.

The invention relates to a pump for conveying waste water or liquids containing solids as well as to an impeller and to a base plate for such a pump in accordance with the preamble of the independent claim of the respective category.

In the conveying of waste water and in particular of domestic waste water, problems result because such liquids contain fibrous materials, cloths, textiles or other solids which can very easily become stuck in the region of the pump and can then result in a reduction in the efficiency, in particular the hydraulic efficiency, of the pump up to the complete blocking of the impeller of the pump and can cause servicing or also complex and/or expensive maintenance work. Special measures therefore have to be taken with such pumps in order effectively to prevent clogging.

Such pumps are frequently configured as centrifugal pumps having radial or semiaxial impellers, with the impeller being able to have only one blade or also a plurality of blades. Impellers having a plurality of blades are as a rule characterized by a higher efficiency, but also make special demands to prevent the deposition or the sticking of solids such as fibrous materials in the conveying path. It is possible, depending on where the stagnation flow is located at the blade, that fibrous materials or similar are pressed onto the surface of the blades and remain there.

Starting from this prior art, it is therefore an object of the invention to propose a pump for conveying waste water or liquids containing solids which is characterized by a very good passage behavior for solids, with the best possible hydraulic efficiency or hydraulic effectiveness being able to be realized. Specifically, an impeller and a base plate for such a pump should also be proposed by the invention.

The subject matters of the invention satisfying these objects are characterized by the features of the independent claims.

In accordance with the invention, an impeller for a pump for conveying waste water is therefore proposed having a support body rotatable about an axis of rotation on which two blades for conveying are provided, with the blades each having an inlet region which extends from an inlet edge up to an apex, wherein the wall thickness of the blade at its end side remote from the support body increases from the inlet edge in the inlet region and reaches its maximum value at the apex, with the blade converging in the inlet region in an axial direction from the support body toward the end side with respect to the wall thickness.

It is achieved by this chamfer of the blade with respect to the axial direction that solids can no longer adhere so easily to the blade, but slide off or slip off due to the slant and are so conveyed onward. A high hydraulic efficiency can simultaneously be realized by the embodiment with at least two blades.

It has proved advantageous in practice if the blades converge in the inlet region at an angle of inclination of at least two degrees.

It is particularly advantageous if the blades in the inlet region converge both on the pressure side and on the suction side at an angle of inclination of at least two degrees. An adhesion of solids both on the pressure side and on the suction side of the blade can be efficiently prevented by the chamfer at both sides in the inlet region. The advantage further results that the blade can be demolded in natural form at least in the inlet region, by which it is meant that in the technical molding manufacture no grains or grains of sand have to be provided in the total inlet region of the blade to allow the blade to be demolded. These surfaces, and in particular the region of the inlet edge, therefore remain free of cleaning work or other material-removing posttreatments such as grinding in the manufacturing process. Such work is namely absolutely necessary when grains or other parts are provided in this region on molding which result in seams, burrs or other irregularities on the casting which subsequently have to be removed.

A further advantageous measure is when a first region in which the blade converges in an axial direction from the support body toward the end side with respect to the wall thickness is provided between the apex and an outlet edge on the pressure side of the blade. For a siding off of fibrous materials or other solids on the pressure side of the blade is thereby also facilitated in this region.

It is preferred for hydraulic reasons or technical flow reasons if a second region in which the blade has a greater wall thickness at its end side than at its side connected to the support body is provided between the apex and the outlet edge on the pressure side of the blade. The blade is preferably undercut in this second region—in contrast to the first region.

A particularly good passage behavior for solids can be achieved when the support body is designed as frustoconical. A deposition of solids is efficiently countered by the slant of the support body. The impeller is then designed as a semiaxial impeller.

In contrast to the general scientific consensus, it has proved advantageous if the inlet edge has a radius of curvature of at least 10 mm, preferably of at least 15 mm. The sliding off of solids at the inlet edge is positively influenced by this very wide or less curved design of the inlet edge.

A further preferred measure is that the inlet edge opens into the support body at an angle of less than ninety degrees. The inlet edge is therefore not perpendicular on the support body with respect to the axial direction, but is rather inclined backwardly viewed in the direction of flow (back swapped leading edge).

The end side of the blade has an appearance reminiscent of a kink in the region of the apex due to the wall thickness of the blade initially increasing toward the apex at the end side and due to the preferably subsequent reduction in the wall thickness at the end side. The associated apical angle is preferably an oblique angle. If therefore a first center tangent is placed at the end side of the inlet region and a second center tangent is placed at the end side of the first region, they intersect at an oblique angle which preferably amounts to at least 100° and at most 125°. This blade thickness distribution is—as will still be explained—in particular advantageous for the interaction with the base plate in accordance with the invention.

It is furthermore advantageous if a central bore is provided in the impeller for receiving a drive shaft as well as a conically designed cap to close the central bore at the blade side. The conical cap, which particularly preferably represents an extension of the conical design of the support body, contributes to the sliding off of solids and thus improves the passage behavior of the impeller with respect to the solids.

The impeller in accordance with the invention can also have three blades.

A base plate is furthermore proposed by the invention for interaction with an impeller designed in accordance with the invention having a central inlet opening for sucking in the waste water and having a running surface adapted to the extent of the support body of the impeller, with at least one first groove being provided in the running surface which extends outwardly from the margin of the running surface facing the inlet opening, with the first groove ending in the running surface. A pulsation effect can be produced on the passing of the blade due to the interaction of this first groove with the blade thickness distribution of the blades of the impeller, said pulsation effect preventing the solids from sticking to the blade.

It is an advantageous measure if at least one second groove is provided in the running surface and extends inwardly from the outer margin of the running surface, with the second groove ending in the running surface, with each second groove being designed without a direct flow communication to one of the first grooves. A relative movement of the solids to the impeller is effected by the second groove provided at the outer margin of the running surface. A cutting effect is hereby additionally made possible which can result in a reduction in size of the solid parts. Since no flow communication exists between the first and second grooves in the running surface, a better efficiency can be achieved because the radial or the semiaxial backflow of the liquid is at least reduced.

It has proved advantageous in practice if the second groove has a greater curvature with respect to the radial direction than the first groove.

The number, the arrangement and the geometry of the grooves in the running surface of the base plate can be otherwise optimized for the application.

A pump is furthermore proposed by the invention for conveying waste water or liquids containing solids having an impeller which is designed in accordance with the invention or having a base plate which is designed in accordance with the invention. Such a pump is characterized by a high efficiency and a very good passage behavior for solids.

The pump is preferably designed as a submersible pump which can be submerged fully or partly into the medium to be conveyed for application as a waste water pump.

Further advantageous measures and preferred embodiments of the invention result from the dependent claims.

Figure 2:
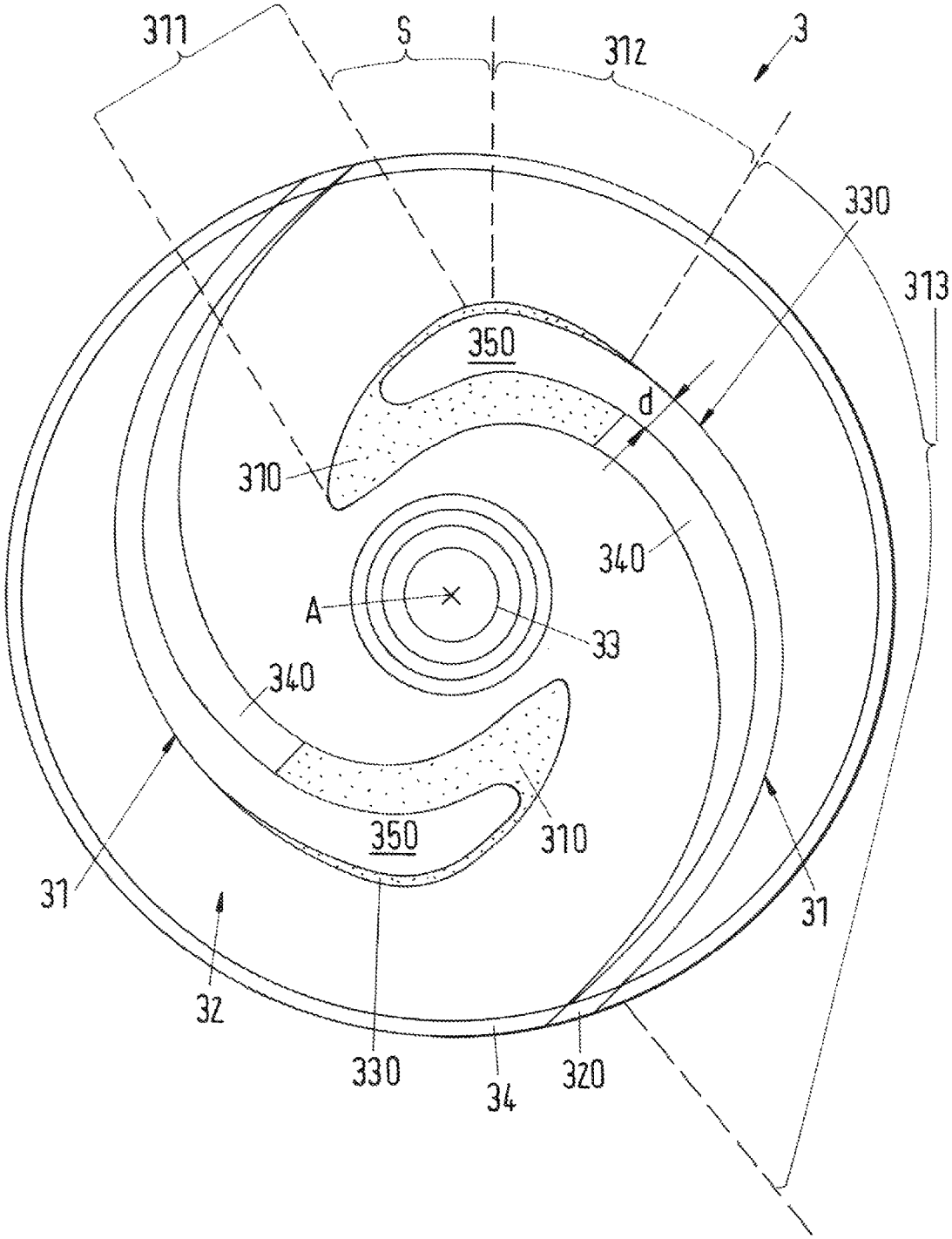
Figure 3:
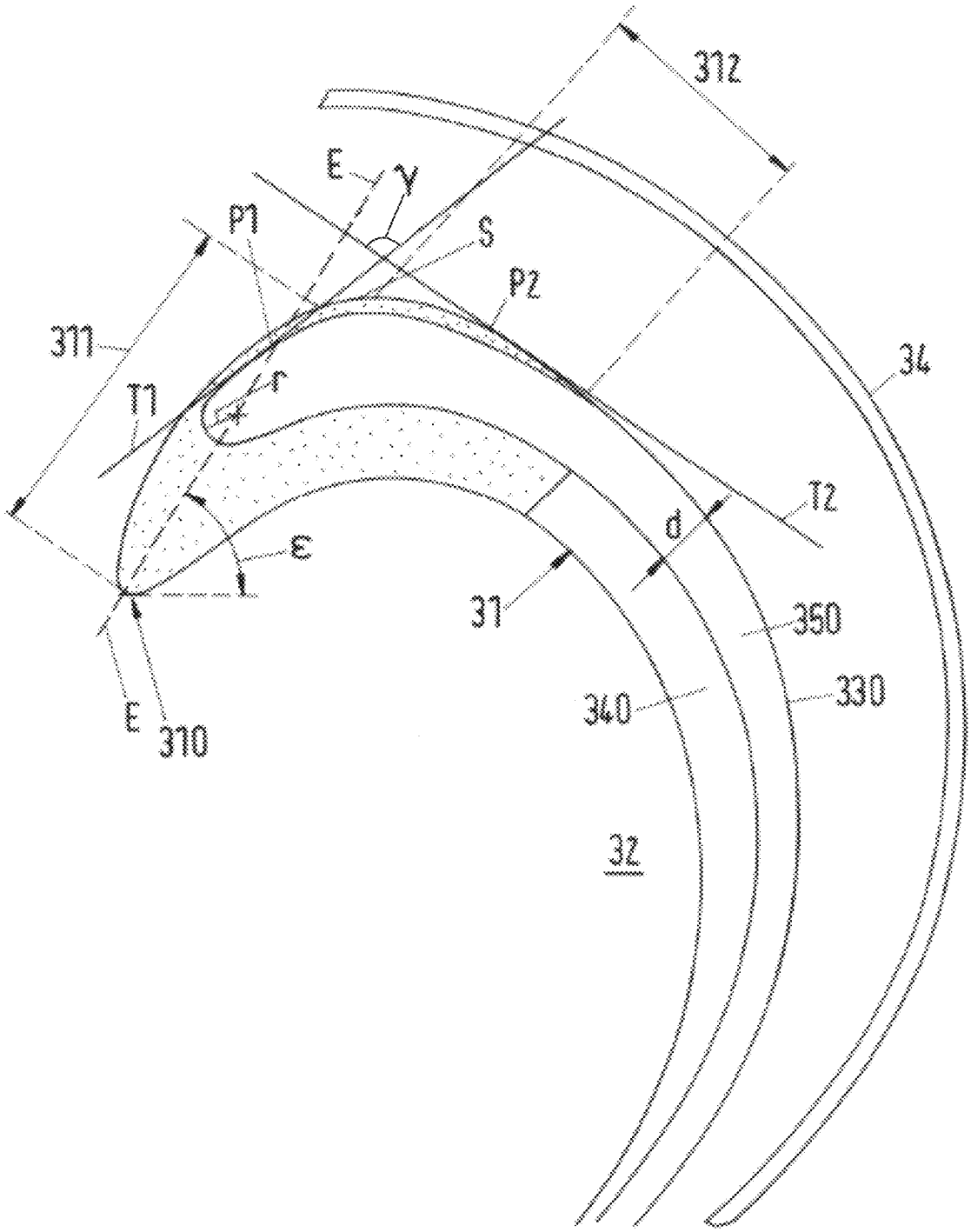
Figure 4:
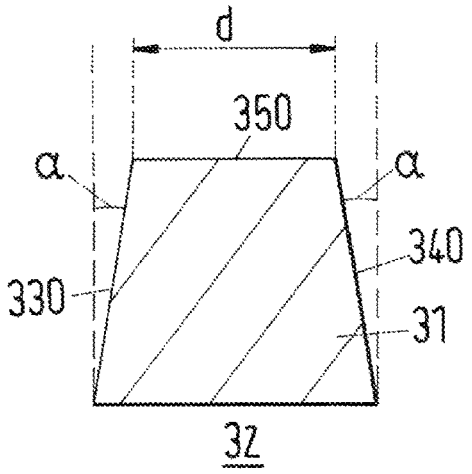

The invention will be explained in more detail in the following with reference to embodiments and to the drawing. There are shown in the schematic drawing, partly in section:

FIG. 1: a section through an embodiment of a pump in accordance with the invention;

FIG. 2: a plan view of an embodiment of an impeller in accordance with the invention;

FIG. 3: an enlarged representation of a blade of the impeller from FIG. 2;

FIG. 4: a sketch to explain the angle of inclination; and

Figure 5:
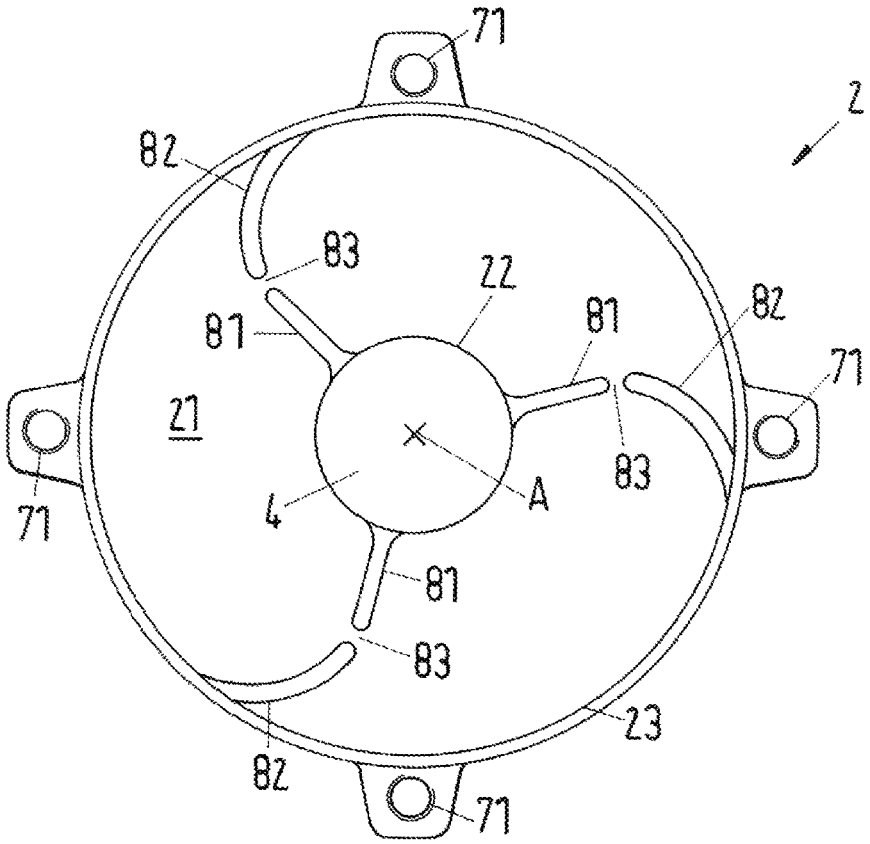

FIG. 5: a plan view of an embodiment of a base plate in accordance with the invention.

FIG. 1 shows in a sectional representation an embodiment of a pump in accordance with the invention for conveying waste water or liquids containing solids which is designated as a whole by the reference numeral 1. The pump 1 includes in a manner known per se a base plate 2 which is provided with a running surface 21 and which is fastened to a housing 6 by means of a plurality of screws 7 and includes an impeller 3 rotatable about an axis of rotation A for conveying the fluid from an inlet opening 4 to an outlet 5 of the pump. In the pump 1 in accordance with the invention, the impeller 3 is designed with a plurality of blades 31, that is at least two blades, which are provided on a support body 32 of the impeller 3. In the embodiment described here, the impeller 3 includes exactly two blades 31; however embodiments are by all means also possible in which the impeller 3 includes more than two blades and in particular three blades. In the operating state, the impeller 3 rotates, driven by an electric motor which is not shown, about the axis of rotation A, thereby sucks the fluid to be conveyed, that is here the waste water, through the inlet opening 4 and conveys it to the outlet 5.

FIG. 2 shows a plan view of an embodiment of an impeller 3 in accordance with the invention and FIG. 5 shows a plan view of an embodiment of a base plate 2 in accordance with the invention.

In the embodiment of the pump 1 in accordance with the invention shown in FIG. 1, both the embodiment of the impeller 3 shown in FIG. 2 and the embodiment of the base plate 2 shown in FIG. 5 are provided. Other embodiments of the pump 1 in accordance with the invention are, however, by all means possible, for example those in which only the impeller or only the base plate are designed in accordance with the invention.

The embodiment of the impeller 3 in accordance with the invention will now be explained with reference to FIGS. 2-4 in the following. One of the two blades 31 of the impeller 3 is shown enlarged in FIG. 3 and FIG. 4 shows a sketch of a cross-section through the blade 31.

The impeller 3 includes the support body 32 which has a central opening 33 for receiving a drive shaft (not shown). In the present embodiment, the support body 32 is designed as frustoconical (see also FIG. 1) such that the support body 32 extends in a converging manner in accordance with the representation in FIG. 2 toward the front out of the plane of the drawing toward the observer, i.e. the central opening 33 in reality lies in front of the drawing plane of FIG. 2.

The two blades 31 are preferably designed as identical and are arranged symmetrical with respect to the axis of rotation A. Each blade 31 extends outwardly from an inlet edge 310 spirally with a changing curvature up to an outlet edge 320 which is arranged at the radially outer margin 34 of the support body 32. As generally usual, the two side surfaces of the blade 31 are called the suction side 340 and the pressure side 330 of the blade 31, with the pressure side 330 being the side surface of the blade 31 remote from the central opening 33, that is further away from the axis of rotation A, and the suction side 340 being the side surface of the blade 31 disposed further inwardly and facing the central opening 33 or the axis of rotation A. The boundary surface of the blade 31 remote from the support body 32 and extending in the direction of the longitudinal extent of the blade 31 is called its end side 350. The end side 350 is thus that boundary surface of the blade 31 which faces the running surface 21 of the base plate 2 in the pump 1.

The blade 31 includes a plurality of regions and has a special wall thickness distribution at the end side 350 of the blade 31. The blade 31 has an inlet region 311 which extends from the inlet edge 310 of rounded design approximately up to an apex S at which the wall thickness d of the blade 31 adopts its maximum value at its end side 350. In the embodiment described here, the blade initially has a first region 312 between the apex S and the outlet edge 320 and subsequent to this a second region 313 which will be explained in more detail further below.

The wall thickness d of the blade 31 at the end side 350 increases constantly from the inlet edge 310 up to the apex S in the inlet region 311. This is in particular reached in that the curvature of the blade 31 in the inlet region 311 is larger at the pressure side 330 than at the suction side 340.

In accordance with the invention, the blade 31 in the inlet region 311 is designed so that it converges with respect to the wall thickness with regard to the axial direction defined by the axis of rotation A from the support body 32 to the end side 350. This is illustrated by the wall regions filled with dots in FIG. 2 and FIG. 3. The sketch in FIG. 4 is intended to make this clear again in that here a section is shown through the blade 31 in the inlet region 311 and perpendicular to the longitudinal extent of the blade 31. It can be recognized that the blade 31 is designed thicker at its end connected to the support body 32 than at the same position at its end side 350. In the embodiment shown here, both the suction side 340 and the pressure side 330 are therefore designed running obliquely with respect to the axial direction such that the blade is thicker on the support body side than at the end side 350. The suction side 340 and the pressure side 330 therefore include an angle of inclination $\alpha$ with the axial direction defined by the axis of rotation A in the inlet region of the blade 31. This angle of inclination $\alpha$ preferably amounts to at least two degrees. It is understood that the angle of inclination $\alpha$ on the pressure side 330 can be equal in amount, but do not have to be equal in amount, with the angle of inclination $\alpha$ on the suction side 340.

Differing from the embodiment described here, it is also possible that the convergence in the inlet region 311 with respect to the axial direction from the support body 3 to the end side 350 is only provided on the pressure side 330 or only on the suction side 340; however, an angle of inclination $\alpha$ differing from zero is preferably both on the suction side 340 and on the pressure side 330 of the blade 31. It is also not necessary here that the convergence on the pressure side 330 or on the suction side 340 is linear or essentially linear in design. Converging portions extending in a curved manner are also possible, with the linear convergence being preferred for technical production reasons.

It is achieved by the convergence in the inlet region 311 that the solids located in the waste water to be conveyed, such as fibrous materials, cloths, textiles or similar, slide off in the inlet region 311 at the slanting pressure side 330 or at the slanting suction side 340 in the direction of the base plate, whereby a deposition of these substances is efficiently prevented. The passage behavior for solids is thus considerably improved; a reduction of the hydraulic efficiency by depositions in the region of the impeller 3 is avoided.

Impellers 3 for such pumps 1 are molded as a rule. A further great advantage of the design with the convergence in the inlet region is that the blade 31 can be demolded in natural form after the molding process due to this convergence. No grains therefore have to be placed into the mold in the inlet region 311 in order subsequently to make the casting demoldable in this region. This is particularly advantageous because particularly the inlet region 311 and the inlet edge 310 of the blade 31 are the most sensitive regions of the blade 31 and are subject to the most stress in the operating state. Since this region can be demolded in a virgin state, no cleaning work such as posttreatment by grinding or other material-removing machining processes are subsequently necessary in the molding shop to remove residues such as seams, burrs or the like caused by grains or other additives.

The inlet region 311 of the blade 31 is the most important region with respect to the throughflow behavior for solids. Many variants are then possible with respect to the further extent of the blade 31 of which here only some will be mentioned.

As can in particular be recognized in FIGS. 2 and 3, in which the sections of the suction side 340 and of the pressure side 330 converging toward the end side 350 of the blade are shown filled with dots, in the embodiment described here, the first region 312 is provided between the apex S and the outlet edge 320 on the pressure side 330, in which region—analog to the inlet region 311—the blade 31 converges in the axial direction from the support body 32 toward the end face 350 with respect to the wall thickness. In this embodiment, both the suction side 340 and the pressure side 330 are designed chamfered in this first region 312 such that the wall thickness of the blade 31 reduces from the support body 32 toward the end face 350.

In addition, in the first region 312, the wall thickness d of the blade 31 measured at the end side 350 decreases from its maximum value at the apex S in the direction of the outlet edge 320.

The second region 313 adjoins the first region in the direction of the outlet edge 320 on the pressure side 330 and the blade 31 is undercut on the pressure side 330 in said second region, that is in this second region 313 the blade 31 has a greater wall thickness at its end side 350 than at the corresponding point at its side connected to the support body 32.

In the second region 313, the wall thickness d of the blade 31 measured at the end side 350 in the direction toward the outlet edge 320 can reduce even further; however, the reduction is less pronounced than in the first region 312. It is also possible that the wall thickness d measured at the end side 350 remains substantially constant in the total second region 313 or initially reduces and then remains constant as it approaches the outlet edge 320.

With respect to the suction side 340, all variants are possible in the second region 313; the suction side 340 can be designed undercut—at least regionally—or also converging over its total extent in accordingly the same manner as was described in connection with the inlet region 311.

As has already been mentioned, the support body 32 in this embodiment is of frustoconical design so that the impeller 3 is designed as a semiaxial impeller 3. In interaction with a base plate 2 adapted thereto (see FIG. 1), a pump 1 then results in which a sliding off of the solids is facilitated by the conical extent and a deposition of said solids at the center—and thus also a clogging—is avoided.

As can in particular also be recognized in the enlarged representation of FIG. 3, the inlet edge 310 of the blade 31 is designed as rounded. In this respect, it has proved to be particularly favorable to provide a large radius of curvature r of at least 10 mm and preferably of at least 15 mm. A very wide or less pronouncedly curved inlet edge 310 in comparison with the prior art results from this, which is usually considered as disadvantageous. It has, however, been found that this large radius at the inlet edge 310 is particularly advantageous to allow solids to slide off at the inlet edge 310.

A further advantageous measure is that the inlet edge 310 does not open perpendicular into the support body 32, but rather inclined to the rear (back wrapped leading edge). This is illustrated with reference to the inlet line E in FIG. 3. This auxiliary line is the apical line of the inlet edge 310. The inlet line E opens into the support body 32 at an acute angle $\varepsilon$, that is at an angle $\varepsilon$ of less than ninety degrees. It is meant by the term "inclined to the rear" that the inlet line E is inclined toward the apex.

As can in particular be recognized from FIG. 3, the curvature of the blade 31 is very small on the pressure side 330 of the end side 350 in the inlet region 311 and in the first region 312 so that in these regions 311, 312 the pressure side 330 can already be approximately be considered as a planar surface in each case. The pressure side 330 therefore appears to kink approximately in the region of the apex S. An apical angle γ can therefore be fixed at which a first center tangent T1 at the end side 350 of the inlet region 311 and a second center tangent T2 at the end side 350 of the first region 312 intersect.

The center of the pressure-side boundary line of the end side 350 in the inlet region 311 is defined as the point P1 and the center of the pressure-side boundary line of the end side 350 in the first region 312 is defined as the point P2. The tangent T1 placed at the point P1 and the tangent T2 placed at the point P2 then intersect at the apical angle γ, It has proven to be advantageous if the apical angle γ is an oblique angle and preferably amounts to at least 100° and at most 125°.

This blade thickness distribution or the blade geometry produces pulsating effects in the liquid in interaction with a base plate 2 in accordance with the invention which prevent solids from sticking to the blade 31.

In addition to the minimal hydraulic blockage, the blade geometry allows a larger spherical passage, in particular a large spherical passage of at least 74 mm. This parameter is a criterion for waste water pumps which is known to the skilled person. Furthermore, a larger angle of enclosure of, for example, at least 190° with two blades 31 and at least 95° with three blades 31 is made possible, which likewise has a positive effect on the hydraulic efficiency. In the case of two blades 31, the angle of enclosure at the end of the blades 31 connected to the support body 32 is preferably at least 180° C. The angle of enclosure of the blade 31 at the end side 350 of the blade 31 facing the base plate 2 in the operating state is preferably at least 145°. The fact that the angle of enclosure at the end side 350 of the blade 31 is preferably smaller than at the end connected to the support body 32 is due to the fact that the inlet edge 310 is preferably designed as inclined to the rear.

A further advantageous measure for preventing deposits of solids is if a conically designed cap 35 (see FIG. 1) is provided for the central opening 33 for receiving the drive shaft to close the central bore 33 of the impeller 3 at the blade side. In this respect, the cone of the cap 35 is preferably designed so that it continues the frustoconical support body 32. The cap 35 preferably has the same conical angle as the frustoconical support body 32.

A further advantageous measure is that this embodiment of the impeller 3 in accordance with the invention is designed to be lathe faced, i.e. the impeller 3 can be lathe faced without problem on a lathe along its radially outer margin or can be machined by means of another cutting process to adapt the outer diameter of the impeller 3 to the respective application. It is thus possible, for example, to lathe face an impeller having an original outer diameter of 380 mm down to an outer diameter of 290 mm. This allows an ideal combination of motor power to demanded hydraulic specifications for the respective application. It is thus possible to adapt the impeller 3 ideally to the application in each case.

In the following, an embodiment of the base plate 2 in accordance with the invention will now be explained in more detail with reference to FIG. 5. FIG. 5 shows a view of the running surface 21 of the base plate 2. The running surface 21 is the surface of the base plate 2 which faces the impeller 3 in the operating state and interacts with it.

The central inlet opening 4 through which the fluid to be conveyed is sucked in is provided in the base plate 2. The running surface 21 is adapted to the extent of the support body 32 with respect to its design (see also FIG. 1). The running surface 21 is therefore also designed as frustoconical with substantially the same conical angle as the support body 32 so that a semiaxial or semiradial pump 1 is realized by the interaction between the impeller 3 and the base plate 2.

Four or more assembly openings 71 are provided at the radially outer margin 23 of the base plate 2 through which the screws 7 (see FIG. 1) engage with which the base plate 2 is fastened to the housing 6. The screws 7 are preferably designed as set screws or adjustment screws to set the gap between the base plate 2 and the blades 31 of the impeller 3 or to reset it after wear.

In accordance with the invention, at least one first groove 81 is provided in the running surface 21 and extends outwardly from the inner margin 22 facing the inlet opening, with the first groove 81 ending in the running surface 21 and not reaching up to its outer margin 23. In the present embodiment, a total of three such first grooves 81 are provided which are distributed evenly, i.e. equidistantly, over the inner margin 22 of the running surface 21 and from which each extends radially outwardly in a straight line. These first grooves 81 produce pulsations or pressure fluctuations in the liquid in interaction with the blades 31 of the impeller 3 which prevent the solids from sticking to the blades 31 of the impeller.

Furthermore at least one second groove 82 is provided in the running surface 21 of the base plate 2 and extends inwardly from the outer margin 23 of the running surface 21, with the second groove ending in the running surface 21 before it reaches its inner margin 22 and without it having a direct flow communication with one of the first grooves 81. In the present embodiment, three second grooves 82 are provided which are distributed equidistantly at the outer margin 23 of the running surface 21 and each extend in a curved manner inwardly from there. Every second groove 82 is designed and arranged so that it extends up to just before the radially outer end of one of the first grooves 81. A respective groove-free transition region 83 is thus provided in the running surface 21 between the radially outer end of every first groove 81 and the radially inner end of the associated second groove 83, which transition region prevents a direct flow communication between the first groove 81 and the second groove 82. The radial backflow of the fluid to be conveyed is considerably reduced by this groove-free transition region 83, whereby the efficiency is increased.

The function of the second grooves 82 is primarily to generate a relative movement of the solids to the impeller 3 and to comminute the solids by a cutting effect.

There are a variety of options which can be adapted to the respective application with respect to the geometrical design such as the extent, width, depth of the first and second grooves 81, 82. There are also numerous options with respect to the number of grooves 81, 82 or their arrangements. The equidistant distribution is by no means necessary. It is also possible that the number of the first grooves 81 can be different from that of the second grooves 82.

The pump 1 in accordance with the invention preferably includes both an impeller 3 in accordance with the invention and a base plate 2 in accordance with the invention. As is normally usual for pumps for conveying waste water or liquids containing solids, the pump 1 is preferably designed as a submersible pump which can be submerged in full or in part into the medium to be conveyed.

The invention claimed is:

1. An impeller for a pump for conveying waste water comprising:

a support body configured to be rotated about an axis of rotation; and two distinct non-contiguous blades separately extending from the support body and positioned radially around the axis of rotation, wherein each blade comprises:

an end side surface remote from the support body, wherein the end side surfaces of the two blades are not contiguous, an inlet edge defining a leading edge of each blade and extending between the support body and the end side surface, wherein the inlet edges of the two blades are spaced apart from each other and are positioned radially around the axis of rotation, a pressure side extending from the inlet edge and facing away from the axis of rotation, and a suction side extending from the inlet edge and facing the axis of rotation, wherein the blades each define an inlet region extending from the inlet edge to an apex of the end side surface, wherein a wall thickness at the end side surface of each blade increases from the end side surface at the inlet edge to a maximum value of the wall thickness at the end side surface at the apex, wherein the suction side of each blade along a length of the inlet region is angled in an axial direction from the support body to the end side surface away from the axis of rotation, and wherein the pressure side of each blade along the length of the inlet region is angled in an axial direction from the support body to the end side surface toward the axis of rotation.

2. The impeller in accordance with claim 1, wherein the suction side and the pressure side of each of the blades in the inlet region are angled in the axial direction so that the suction side and pressure side converge linearly at an angle of inclination of at least two degrees.

3. The impeller in accordance with claim 1, wherein each blade comprises a first region extending from the apex toward an outlet edge of the blade in which the blade tapers in the axial direction from the support body toward the end side surface.

4. The impeller in accordance with claim 3, wherein each blade comprises a second region extending from the first region toward the outlet edge in which the blade has a larger wall thickness at its end side surface than at its side connected to the support body.

5. The impeller in accordance with claim 3, wherein a first point is defined at a center of a length of the pressure side of the end side surface of the inlet region of each blade and a second point is defined at a center of a length of the pressure side of the end side surface of the first region of each blade, and wherein a first center tangent line tangent to the end side surface at the first point and a second center tangent line tangent to the end side surface at the second point intersect at an oblique angle between 100° and 125°.

6. The impeller in accordance with claim 1, wherein the support body comprises a frustoconical surface from which the blades extend, wherein portions of the frustoconical surface are present on the pressure side and the suction side of the inlet region of each blade.

7. The impeller in accordance with claim 6, wherein the support body defines a central bore configured for receiving a drive shaft, and wherein the impeller further comprises a conical cap positioned within the central bore and defining a second frustoconical surface contiguous with the frustoconical surface of the support body.

8. A base plate configured to interact with the impeller of claim 6, comprising:

a central inlet opening configured for sucking in the waste water, and a frustoconical running surface adapted to the extent of the support body of the impeller, wherein at least one first groove is provided in the running surface and extends outwardly from the margin of the running surface facing the inlet opening, wherein the first groove ends in the running surface.

9. The base plate in accordance with claim 8, wherein at least one second groove is provided in the running surface and extends inwardly from the outer margin of the running surface, wherein the second groove ends in the running surface and wherein every second groove is designed without direct flow communication with one of the first grooves.

10. The base plate in accordance with claim 9, wherein the second groove has a greater curvature than the first groove with respect to the radial direction.

11. A pump for conveying waste water or liquids containing solids having a base plate which is designed in accordance with claim 10.

12. The impeller in accordance with claim 1, wherein the inlet edge at the end side surface defines a radius of curvature of at least 10 mm.

13. The impeller in accordance with claim 1, wherein the inlet edge is swept back relative to the axis of rotation from the support body to the end side surface at an angle of less than ninety degrees.

14. A pump for conveying waste water or liquids containing solids having an impeller which is designed in accordance with claim 1.

15. The pump in accordance with claim 14, which is designed as a submersible pump.

* * * * *